US005881917A

United States Patent [19]

Jones et al.

[11] Patent Number: 5,881,917

[45] Date of Patent: Mar. 16, 1999

[54] BEVERAGE DISPENSER HAVING IMPROVED ACTUATOR MECHANISM

[75] Inventors: Brian Carter Jones, Collinsville, Conn.; Jeffrey Alan Rutchik, North Easton, Mass.; Robert Allen Crosby, Jr., Scituate, Mass.; David George Kmetz, Douglas, Mass.

[73] Assignee: IMI Wilshire Inc., Anoka, Minn.

[21] Appl. No.: 924,366

[22] Filed: Sep. 5, 1997

Related U.S. Application Data

[60] Provisional application Nos. 60/025,943 Sep. 11, 1996 and 60/025,942 Sep. 11, 1996.

[51] Int. Cl.[6] ..... B67D 5/56; B67D 5/52; H01H 35/38

[52] U.S. Cl. ..... 222/129; 222/129.1; 222/132; 222/135; 200/82 R; 200/83 Z

[58] Field of Search ..... 222/129, 129.1, 222/135, 132; 200/81 R, 82 R, 81 H, 83 Z

[56] References Cited

U.S. PATENT DOCUMENTS

| | | | |
|---|---|---|---|
| 4,095,722 | 6/1978 | Miller | 222/108 |
| 4,174,872 | 11/1979 | Fessler | 312/290 |
| 4,333,587 | 6/1982 | Fessler et al. | 222/129.1 |
| 4,432,470 | 2/1984 | Sopha | 222/135 |
| 4,577,782 | 3/1986 | Fessler | 22/129.1 |
| 4,647,738 | 3/1987 | Diamond | 200/81 H |
| 5,697,526 | 12/1997 | Lee | 222/132 |

*Primary Examiner*—Andres Kashnikow
*Assistant Examiner*—Keats Quinalty
*Attorney, Agent, or Firm*—Sten Erik Hakanson

[57] ABSTRACT

A dispenser includes a plurality of beverage dispensing valves mounted thereto along a front end thereof Each valve includes an air switch that is pneumatically operable to turn its associated valve on and off. An equal plurality of air actuators are secured to an elongate panel hingedly secured to the dispenser front surface. Each air actuator includes a pressurized chamber and a pliable front surface. Flexible tubes extend between the air switches and the air actuators for communicating pneumatic pressure there between. The air actuators include a graphics layer secured to the front surfaces thereof. In operation, a front surface an air actuator is depressed manually whereby pneumatic pressure created thereby in the pressurized chamber is communicated by the tube thereof to its particular air switch. The air switch then serves to operate a solenoid of the valve with which it is associated, resulting in dispensing of the beverage. Release of pressure on the actuator front surface breaks the electrical connection stopping dispensing.

3 Claims, 6 Drawing Sheets

80
90
80
86
88
50
84
92
82
51
62
55
53
53
52

BEVERAGE DISPENSER HAVING IMPROVED ACTUATOR MECHANISM

This application is a co-pending nonprovisional filing based upon the provisional filing identified as U.S. Ser. No. 60/025,942 filed Sep. 11, 1996, now abandoned, and U.S. Ser. No. 60/025,943 filed Sep. 11, 1996, now abandoned.

FIELD OF THE INVENTION

The present invention relates generally to beverage dispensers, and more particularly to actuator mechanisms used to operate the beverage dispensing valves thereof.

BACKGROUND

Beverage dispensers having one or more beverage dispensing valves for dispensing carbonated or non-carbonated beverages are well known. The beverage valves are generally actuated in one of two ways. The first type of actuator comprises a lever that depends from an area behind a dispensing nozzle of the valve. A cup is pressed against this lever to start a flow of beverage into the cup and the beverage flow stops when the cup is removed. Such actuators are commonly used by food service personnel, and are easy to operate with one hand.

In self service operations, however, customers may drink from a cup and then return to the dispenser for a refill. It is likely that the lip of the cup from which the customer has drunk will come into contact with the dispensing lever. Sanitary considerations therefore generally preclude the use of such actuators in self service settings. Thus, the second type of common actuator is a push button located above the dispensing nozzle and in proximity to information about the beverage available at each nozzle. These push buttons comprise electrical switches which are toggled by a user's fingers. These switches must be durable as customers may abuse them by pushing too hard or by repeatedly opening and closing a switch when they don't push hard enough or when they attempt to top off a cup of beverage. Because these switches are touched repeatedly by customers, many of whom have been handling food, they must also be cleaned frequently. The switches must therefore be well sealed to prevent the entry of water into the electrical wiring. They also must be well insulated to prevent electrical shocks to customers who may have wet hands or be standing on a wet floor in front of the dispenser.

A further problem with electrical push button switches concerns their size and required actuation pressure. The target or push button area for positively actuating such switches is relatively small, and can be turned off if sufficient force is not constantly applied during the entire filling process. Thus, a small electrical switch button that can turn off, even by a slight release of the pressure thereon, is not desirable for someone who may be carrying a other objects, such as a tray of food, and who can not devote full attention to operating the dispenser because their attention must be focused on others, such as children. In addition, since prior art self serve electrical buttons are relatively small, the advertising graphics indicating the particular flavor beverage can not be practically placed thereon. Thus, it can be very easy to push the button that activates the wrong flavor dispensing valve, again, particularly where the operator's full attention is otherwise divided.

SUMMARY OF THE INVENTION

The present invention comprises a beverage dispenser having a plurality of beverage dispensing valves mounted thereto along a front end thereof. Each valve includes an air switch that is pneumatically operable to turn its associated valve on and off. An equal plurality of air actuators are secured to an elongate panel hingedly secured to the dispenser front surface. Each air actuator includes a pressurized chamber and a pliable front surface. Flexible tubes extend between the air switches and the air actuators for communicating pneumatic pressure there between. The air actuators include a graphics layer secured to the front surfaces thereof.

In operation, an air actuator is depressed manually whereby pneumatic pressure created thereby in the pressurized chamber is communicated by the tube thereof to its particular air switch. The air switch then serves to operate the solenoid of the valve with which it is associated, resulting in dispensing of the beverage. Release of pressure on the actuator front surface breaks the electrical connection and dispensing stops.

Numerous advantages are realized by using such switches on the front of a beverage dispenser. The first is the relatively large button size and low cost that can be achieved using a pneumatic approach as compared to comparable equipment in an electrical push button. Such pneumatic buttons can therefore provide a large area for displaying the graphical information about the product. These buttons are user friendly, easy to operate and have excellent tactile qualities which are liked by users. Because they operate when relatively little pressure is applied to the chamber and continue to stay on even if some pressures thereon is partially reduced after an initial pressure is applied, they are easier to use. Thus, the user does not have to focus much attention thereon and does not have to reactivate the button by pushing it several times. Since graphics as to the flavor of the beverage can be placed clearly on the pneumatic actuator button surface, even the most harried customer will be able to easily and reliably select the desired drink. Moreover, the relatively large size of the button with the graphics thereon provides for a more exciting and enticing point of purchase display. Also, the front portion of the switch that is operated by users has no moving parts, which significantly improves reliability. Furthermore, the portions of the mechanism that the user comes in contact with are electrically isolated from the electrical elements of the dispenser. This reduces the chance that customers will receive an electric shock when operating the dispenser or that employees will be shocked or will short circuit the dispenser when cleaning the dispenser buttons with a liquid. Moreover, the simplicity of these switches and the reduction in the amount of wiring necessary reduces assembly time and manufacturing cost.

The elongate panel in its closed position partially covers the valves and fully encloses the tubes and air switches. The panel can be swung open to provide access to the air switches and tubing, the tubing pieces being of sufficient length to permit the opening thereof. In addition, the tubing pieces can be easily manually pulled and disconnected from both the air actuators and the air switches without the need for tools. And since the only connection between the air actuators and the air switches is the tubing, access thereto and the beverage valves for maintenance and repair is easily and safely accomplished. In contrast, conventional valves are typically each enclosed in their own separate housings of which the electrical switches are and integral part. Thus, access to such valves must be done individually and the electrical components can be more difficult to disconnect and work with.

DESCRIPTION OF THE DRAWINGS

A better understanding of the structure, and the objects and advantages of the present invention can be had by reference to the following detailed description which refers to the following figures, wherein.

DETAILED DESCRIPTION OF THE PREFERRED EMBODIMENT

Figure 1:
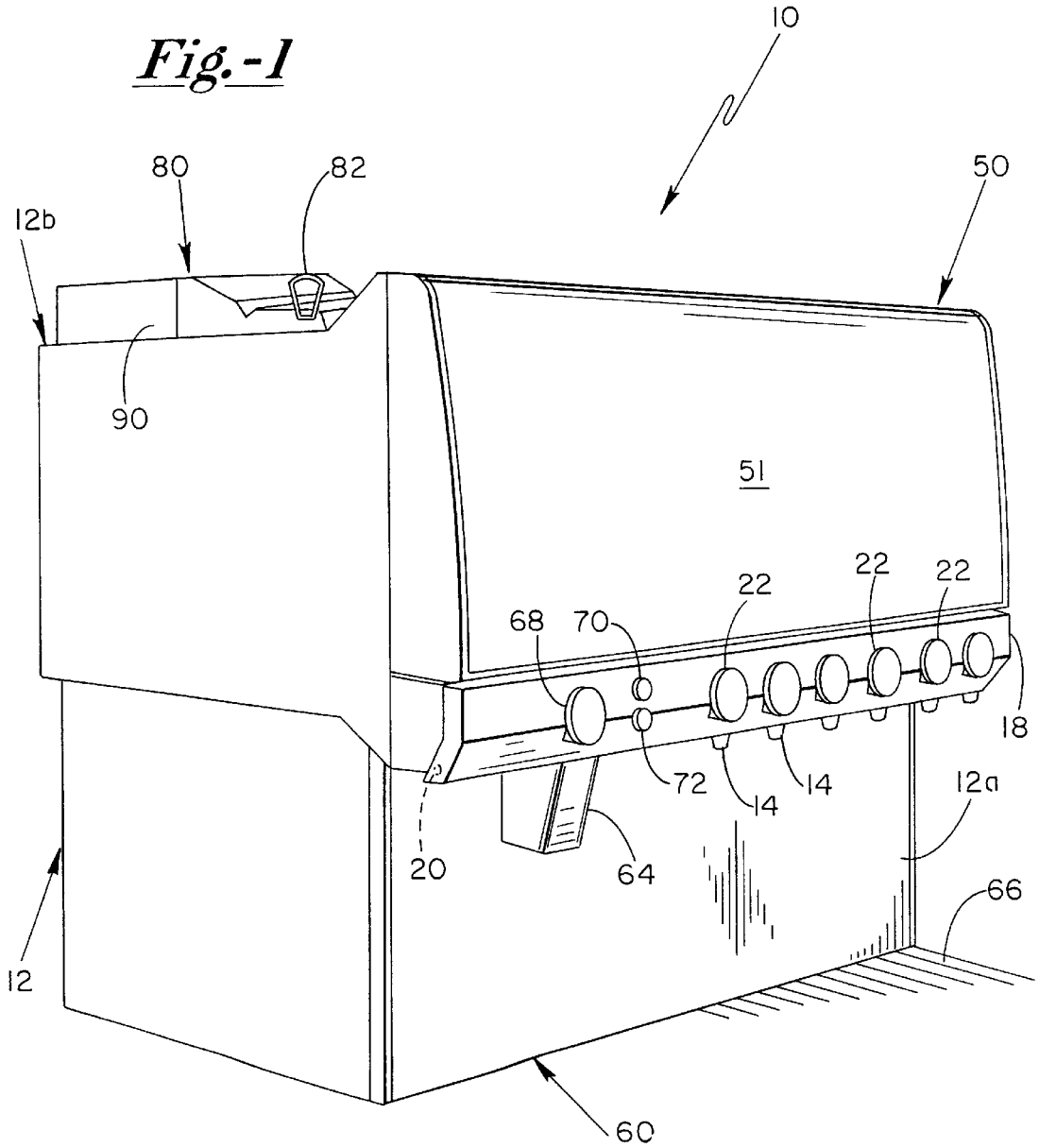
FIG. 1 shows a perspective view of a beverage dispenser.
Figure 2:
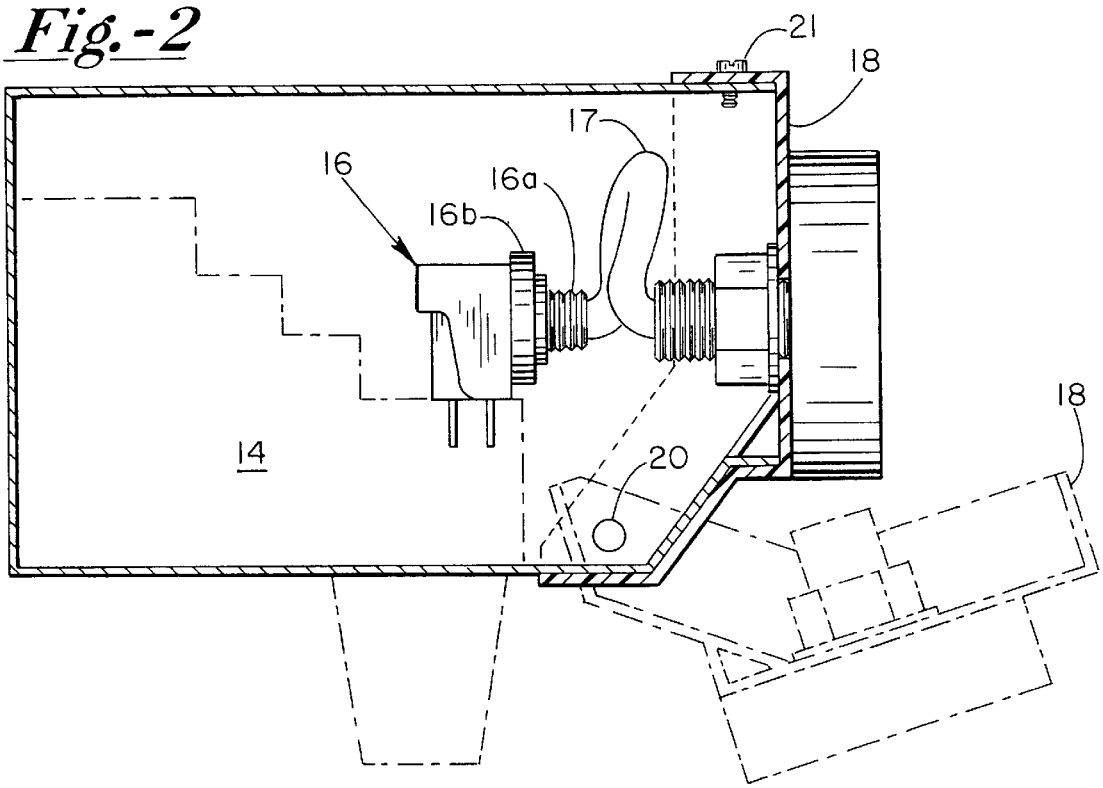
FIG. 2 shows a cross-sectional view along lines 2—2 of FIG. 1.
Figure 3:
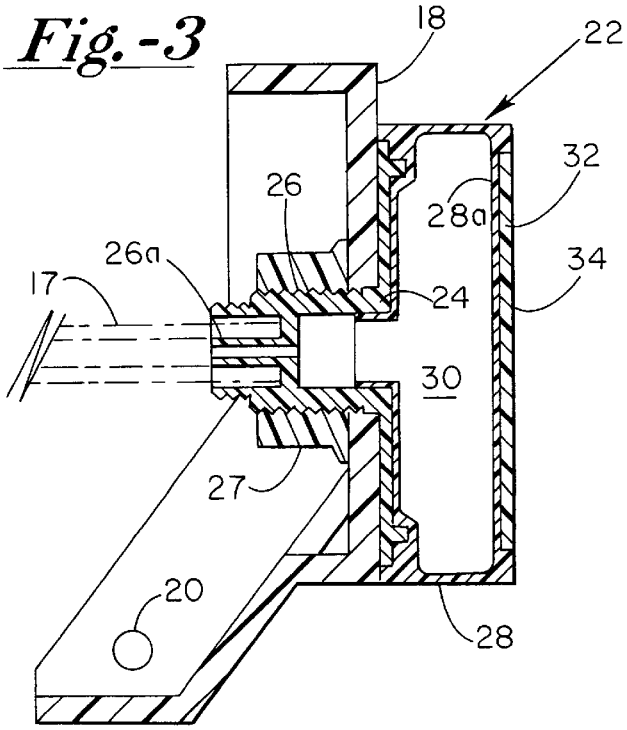
FIG. 3 shows a cross-sectional view along lines 3—3 of FIG. 2.
Figure 4:
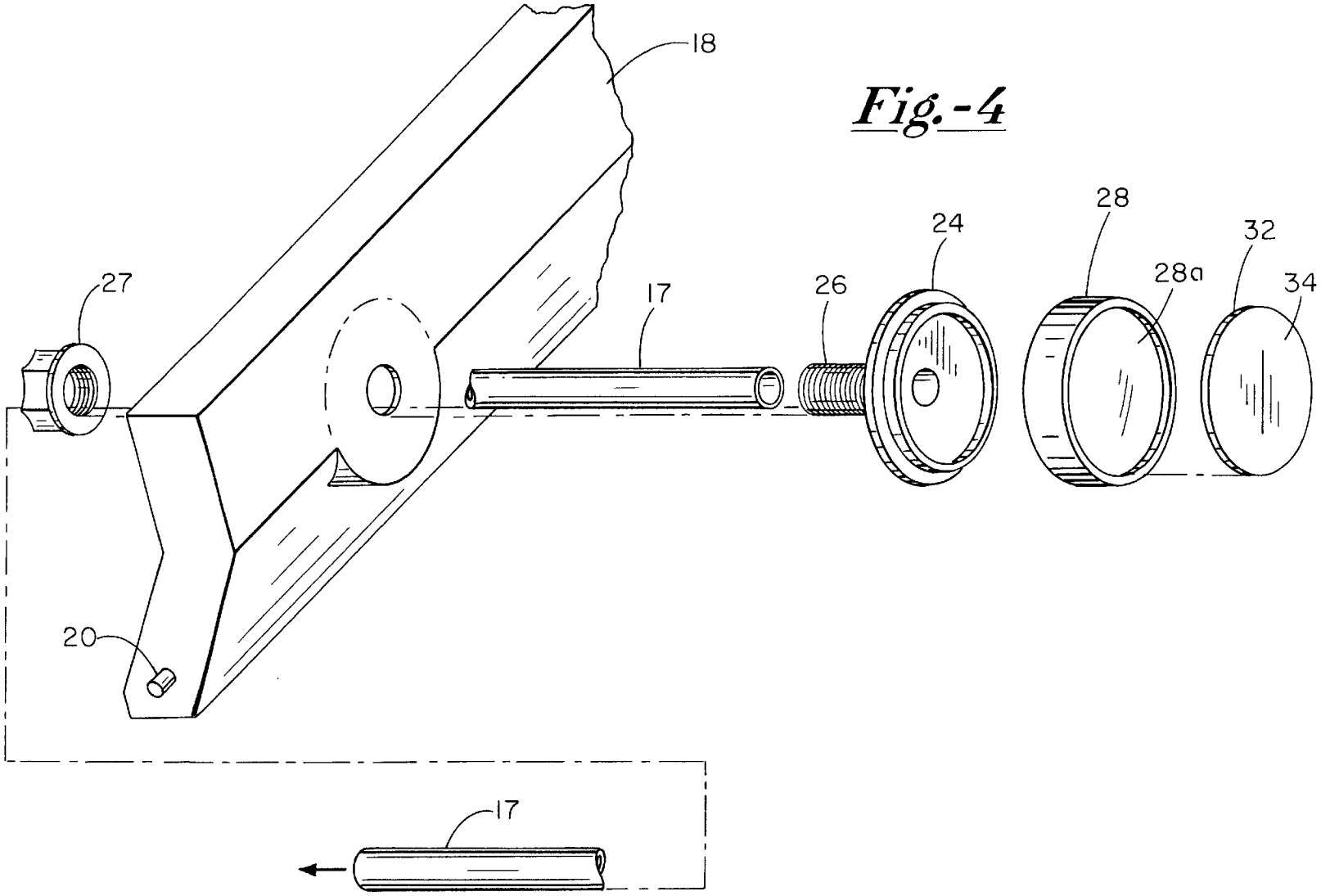
FIG. 4 shows a an exploded view of the air actuator and its manner of mounting to the air actuator support panel.
Figure 5:
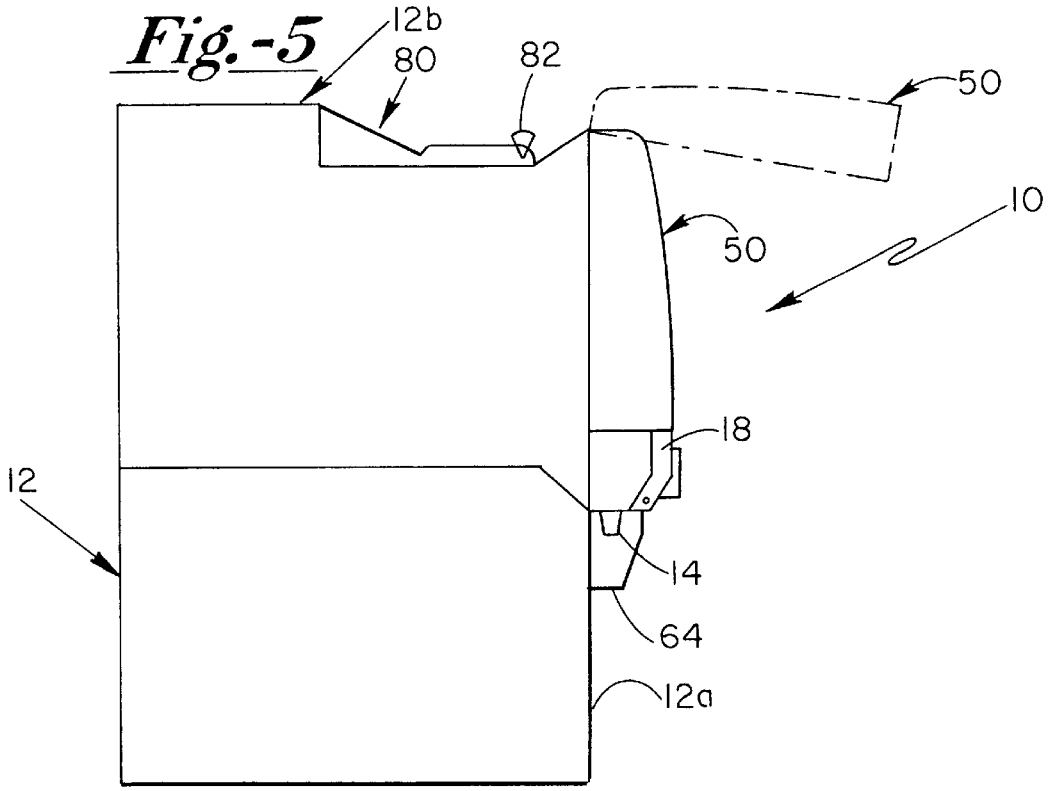
FIG. 5 shows a side plan end view of the beverage dispenser.
Figure 6:
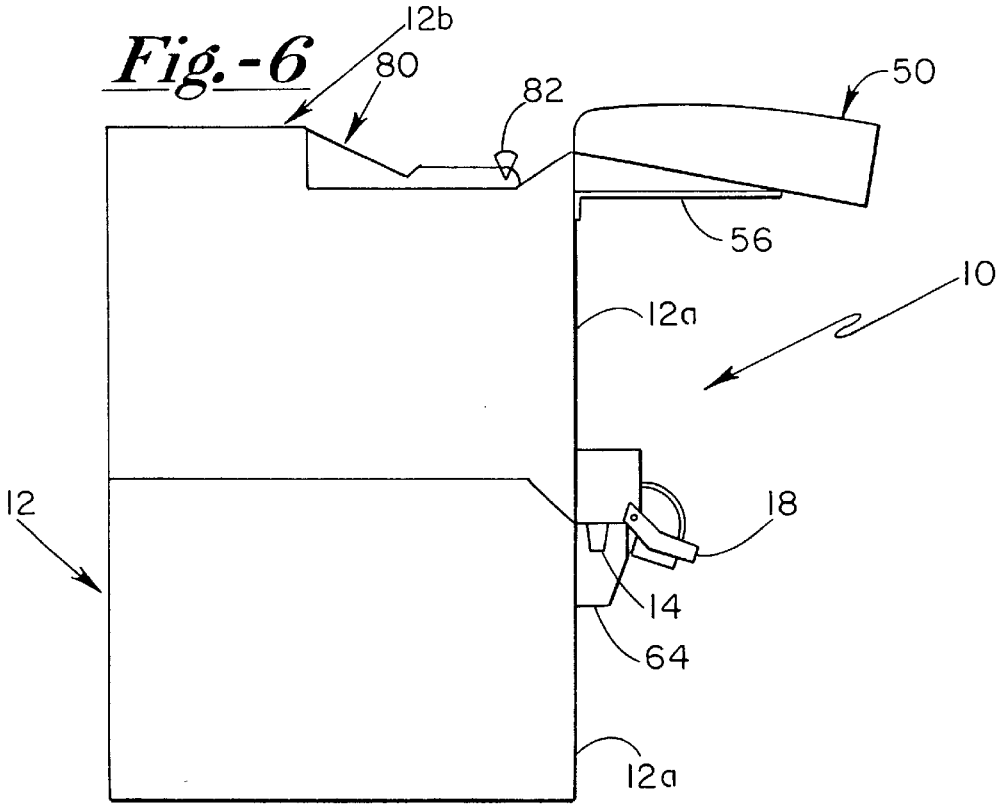
FIG. 6 shows side plan end view of the beverage dispenser with the merchandising cover and air actuator support panel open.

A beverage dispenser is seen in FIG. 1 and generally designated by the numeral 10. As seen by also referring to FIGS. 2–4, dispenser 10 includes a housing 12 including a front portion 12*a* and top portion 12*b*. A plurality of beverage dispensing valves 14 are secured to dispenser 10 and each valve 14 includes an air pressure operable switch 16 electrically connected thereto. Switches 16 include air stems 16*a* that provide for releasable connection with a plastic tube 17. As is known in the art, stem 16*a* communicates air pressure into a housing 16*b* in which a diaphragm, not shown, is moveable by air pressure to operate a micro switch, also not shown. In the preferred embodiment, switches 16 are directly physically secured to valves 14. Each valve 14 includes a solenoid, not shown, for opening and closing thereof in response to signals from the diaphragm actuated micro switch of its corresponding switch 16.

An elongate horizontally extending panel 18 is pivotally secured to the front end or front portion 12*a* of dispenser 10 by hinge points 20. Typically, as is known in the art, the valves are secured to a splash panel or equivalent rigid support structure. As understood by referring to FIG. 2, screws 21 serve to secure panel 18 in the closed position shown therein by the solid lines thereof. The open position of panel 18 is indicated by the dashed lines thereof in FIG. 2. A plurality of air actuators 22 are secured to panel 18. As seen by also referring to FIG. 3, each actuator 22 includes a rigid base 24 having a threaded stem tube 26 extending therefrom. Stem 26 extends through holes in panel 18 and are secured thereto by nuts 27 and includes a nipple for releasable securing to tube 17. Actuators 22 include a portion 28 made of a pliable material sealably secured to base 24 which together define an air pressure space 30. Portion 28 has a front contact surface 28*a*. A round flexible graphics sheet 32 includes printing for indicating brand and or flavor of the beverage dispensed by a particular valve 14. A clear flexible plastic overlay 34 is secured directly to the graphics side of sheet 32 which together are adhered to contact surface 28*a*. Air pressure operable switches, such as switches 16, as well as the corresponding actuating equipment, such as actuators 22 and tubes 17, are known in the art and available, for example, from Press:Air:Trol Corporation, 1009 West Boston Road, Mamaroneck, N.Y., 10543.

In operation, a contact surface 28*a* is depressed manually by pressing against its surface as covered by sheet 32, which causes an increase in air pressure in space 30. This pressure increase is communicated in turn through stem 26, tube 17, stem 16*a* and into chamber 16*b*. Such pressure deforms the diaphragm therein operating the micro switch thereof which then operates the solenoid of the corresponding valve 14, resulting in dispensing of beverage therefrom. Release of pressure on contact surface 28*a* reverses the foregoing stopping dispensing. It can be appreciated that contact surface 28*a* can provide a large relatively inexpensive actuation target for the user of dispenser 10. It will be understood by those of skill that a slight depression of area 28*a* allows for positive operation of a valve 14. In addition, the mechanism that initiates the opening of a valve 14 can be somewhat remote from the valve itself. Thus, as is the case with panel mounted actuators 22, the valves 14 and switches 16 can be isolated somewhat from user contact, as opposed to having the actuating mechanism directly secured to the valve. Furthermore, since panel 18 can be opened, service of switches 16, actuators 22 and valves 14 is easily facilitated.

Figure 7:
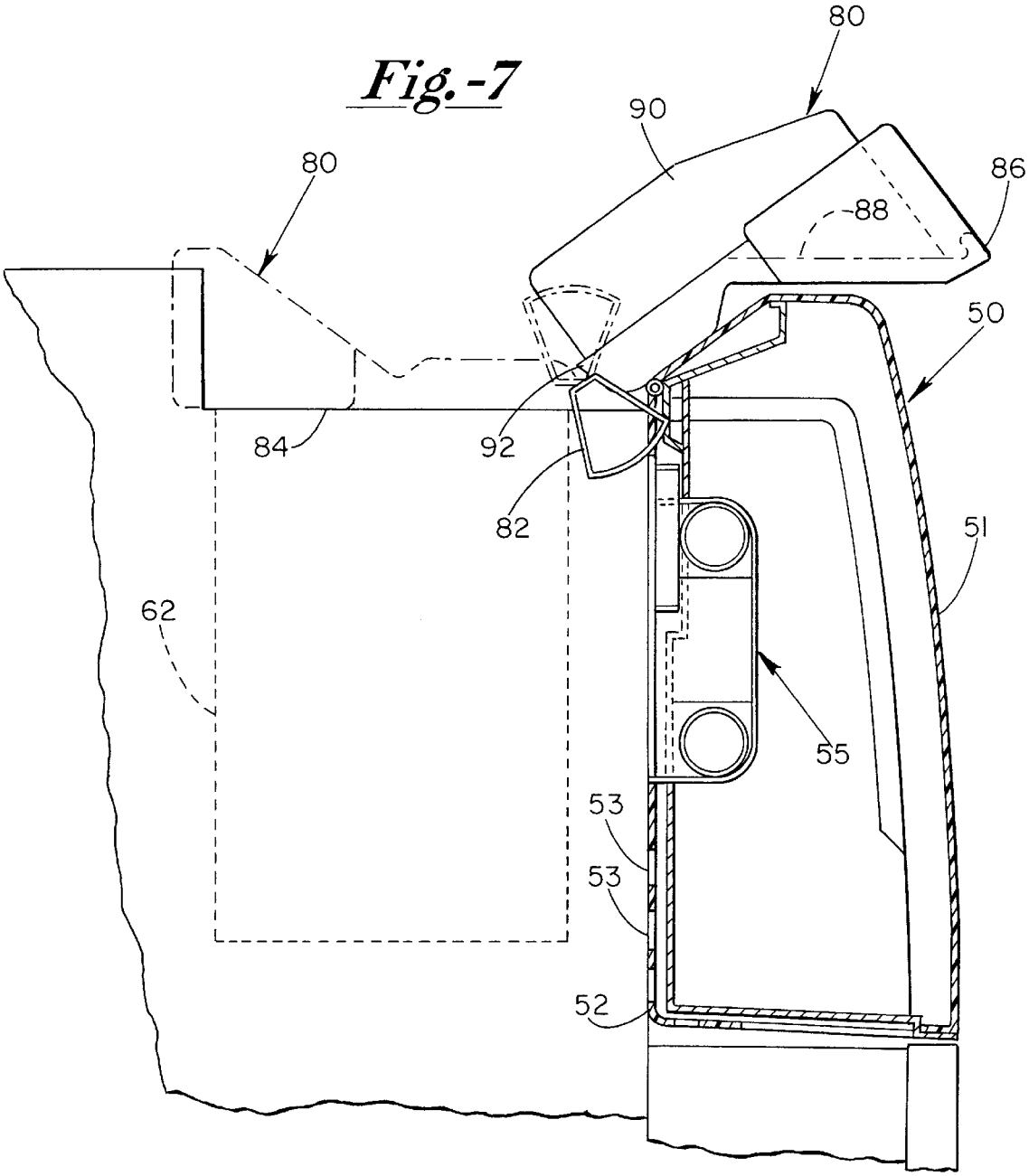
FIG. 7 shows a partial cross-sectional view along lines 7—7 of FIG. 1.
Figure 8:
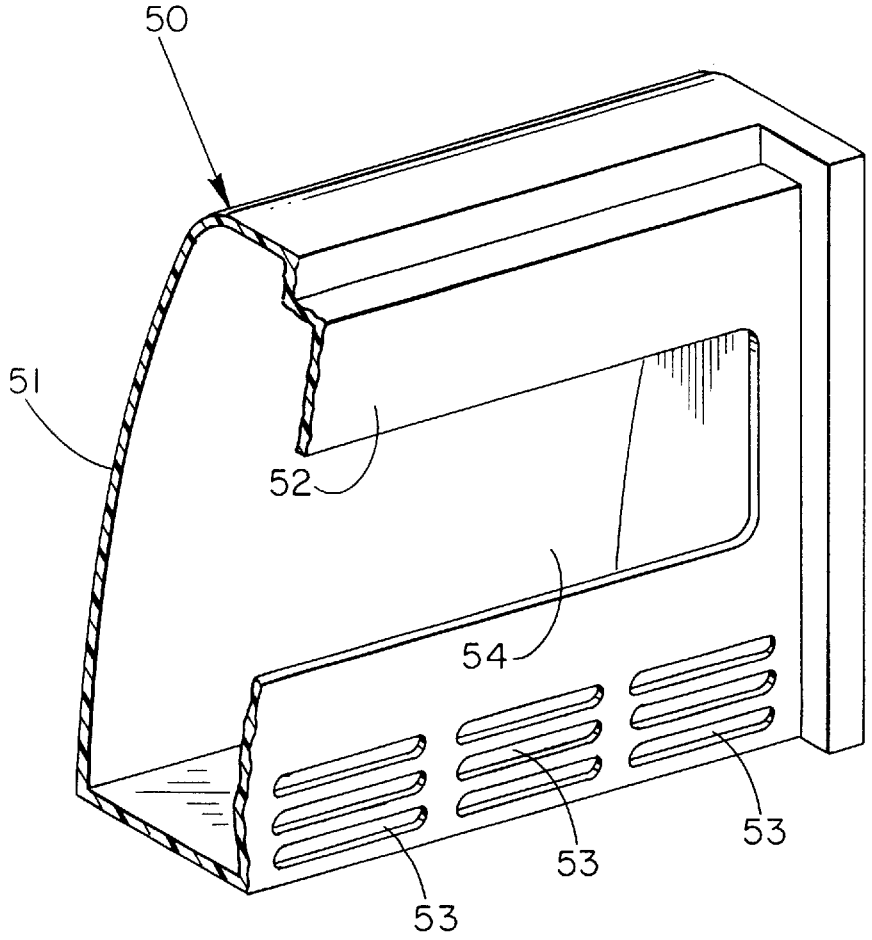
FIG. 8 shows a perspective cross-sectional view of the merchandiser cover.

As seen by also referring to FIGS. 5–8, dispenser 10 includes a merchandiser cover 50 pivotally secured to top surface 12*b* of dispenser 10. Cover 50 includes a front surface 51 for retaining a merchandising transparency. Cover 50 also includes an inner panel 52 having a plurality of air flow louvers 53 and a light fixture opening 54. Fluorescent lights 55 are secured to dispenser 10 and provide for back lighting of the transparency held against and covering surface 51. Lights 55 extend through opening 54 when cover 50 is closed, as seen in FIG. 7, whereby panel 52 serves to direct light to the transparency. Louvers 53, of course, provide for circulation of cooling air so as to reduce heat produced by lights 55. It will be appreciated that access to screws 21 for opening of panel 18 is facilitated by first opening cover 50. A pair of cover support rods 56 are secured to dispenser 10 and can be swung out to support cover 50 in its open position.

Dispenser 10 includes an ice dispensing portion 60 having an ice retaining bin 62 and an ice dispensing chute 64. As is known by those of skill, an ice dispense mechanism is located in bin 62 and serves to move ice into chute so that it falls there through by the force of gravity into a suitable container resting on drip tray 66. It will also be understood by those of skill that an air actuator 68, of the same construction as actuators 22, servers to initiate the operation of the ice dispensing mechanism. In particular, a further air switch, not shown, operates in the same manner as switches 16 to electrically initiate the operation of the ice dispense mechanism. Portion 60 also includes a switch 70 for dispensing plain water from a solenoid operated water valve, not shown, and a switch 72 for dispensing carbonated water from a solenoid operated carbonated water valve, also not shown.

A combination ice loading chute and ice bin cover 80 is seen, for example, in FIG. 7. Chute cover 80 is pivotally secured to dispenser top 12*b* and includes a handle 82 for moving it between a closed position as seen in FIG. 1 and an open position as depicted in FIG. 7. In the closed position it serves to cover an opening 84 into bin 62 and prevent contaminants from entering therein. In the open position the chute cover 80 is converted into an ice conveying chute having an outer lip edge 86, a bottom ice guiding surface 88, a pair of ice guiding walls 90 and a rear edge 92. When chute cover 80 is in the open position, a container of ice cubes, such as a bucket, can be lifted to the lip 86 of chute cove 80 and pivoted thereon so as to empty its contents onto surface

88. It can be understood that the ice will then flow along surface 88 under the force of gravity to rear edge 92 whereupon it will fall into bin 62. Chute cover 80 provides the advantage of extending out beyond cover 50 so that the exact ice pour point is clearly seen and easily targeted. Also, walls 90 serve to direct the ice cubes so they remain on and flow along surface 88. Prior art dispensers simply have a removable cover covering the ice bin opening thereof. However, since such opening is generally over five feet above the floor surface, a foot stool or ladder is generally needed so that the exact perimeter of the opening can be seen during the pouring operation. Otherwise, incorrect targeting of the ice will result in cubes hitting the perimeter of the ice bin opening or the top of the dispenser resulting in ice being spilled on the floor. The presence of ice on a floor surface presents a well recognized safety hazard. Chute cover 80 thus greatly reduces this hazard, can eliminate the need for a stool or ladder, and provides for a quicker ice bin filling process.

What is claimed is:

1. A beverage dispenser, comprising:

one or more electrically operated beverage dispensing valves secured to and along a front portion of the beverage dispenser, one or more air actuators secured to and along the front portion of the beverage dispenser adjacent the one or more beverage dispensing valves, each air actuator having a front contact surface for displaying graphics indicia on an external surface thereof, and an internal air space, one or more air pressure operable electrical switches, each of the one or more air pressure operable electrical switches connected to one of the one or more beverage dispensing valves, one or more lengths of tubing, each one of the one or more lengths of tubing providing for pneumatic communication between one of the one or more air pressure operable switches and a corresponding one of the internal air spaces of the one or more air actuators so that manual depression of an air actuator front contact surface communicates air pressure to a corresponding one of the one or more air pressure operable switches for electrically operating a corresponding one of the one or more beverage dispensing valves to dispense a beverage.

2. The dispenser as defined in claim 1, and further including an actuator panel pivotally secured to the front portion of the beverage dispenser and the one or more air actuators secured to an exterior surface of the actuator panel along a length thereof and the actuator panel operable between an open position and a closed position wherein the actuator panel provides access to the one or more beverage dispensing valves, the one or more air pressure switches and to the one or more lengths of tubing when in the open position, and substantially encloses the one or more beverage dispensing valves, the one or more air pressure switches and the one or more lengths of tubing when in the closed position.

3. The dispenser as defined in claim 2 and the one or more air pressure switches secured directly to one of the corresponding one or more beverage dispensing valves.

* * * * *